US007244005B1

(12) United States Patent
Lu

(10) Patent No.: US 7,244,005 B1
(45) Date of Patent: Jul. 17, 2007

(54) SLIDING RAIL ASSEMBLY AUTO LOCKING STRUCTURE FOR DRAWER

(75) Inventor: Chun-Min Lu, Taipei Hsien (TW)

(73) Assignee: Gslide Corporation, Taipei Hsien (TW)

( * ) Notice: Subject to any disclaimer, the term of this patent is extended or adjusted under 35 U.S.C. 154(b) by 0 days.

(21) Appl. No.: 11/477,605

(22) Filed: Jun. 30, 2006

(30) Foreign Application Priority Data

Jun. 8, 2006 (TW) ..... 95209980 U

(51) Int. Cl.
*A47B 88/04* (2006.01)

(52) U.S. Cl. ..... 312/333; 312/319.1

(58) Field of Classification Search ..... 312/330.1, 312/333, 334.1, 334.7, 334.8, 334.44, 334.47, 312/319.1; 384/21, 22
See application file for complete search history.

(56) References Cited

U.S. PATENT DOCUMENTS 5,207,781 A * 5/1993 Rock ..... 312/319.1
5,302,016 A * 4/1994 Lautenschlager et al. ... 312/333
6,672,692 B2 * 1/2004 Weng ..... 312/333
6,799,817 B1 * 10/2004 Chu ..... 312/333
6,979,066 B2 * 12/2005 Yang ..... 312/333
7,077,487 B2 * 7/2006 Yang ..... 312/333
7,159,958 B1 * 1/2007 Lu ..... 312/334.44
2002/0033658 A1 * 3/2002 Salice ..... 312/334.14
2005/0093406 A1 * 5/2005 Yang ..... 312/333

FOREIGN PATENT DOCUMENTS

KR 2001-0269498 * 3/2002
KR 2001-0269499 * 3/2002
TW 092136773 * 11/2004
WO WO 01/08279 * 2/2001

* cited by examiner

*Primary Examiner*—James O. Hansen
(74) *Attorney, Agent, or Firm*—Troxell Law Office, PLLC

(57) ABSTRACT

A sliding rail assembly auto locking structure for drawer is disclosed comprised of a holder base, a swivel hook, a slide, two return springs, an actuating block. When an arched block of the swivel hook is approaching a recess in the holder base for positioning, the arched block does not fall to the recess directly, and at this time, oblique guide grooves of the swivel hook are moved over associating guide blocks of the holder base to guide the arched block into the recess slowly and smoothly, and therefore the inner sliding rail of the sliding rail assembly is moved with the drawer smoothly without vibration.

6 Claims, 16 Drawing Sheets

SLIDING RAIL ASSEMBLY AUTO LOCKING STRUCTURE FOR DRAWER

BACKGROUND AND SUMMARY OF THE INVENTION

The present invention relates to a sliding rail assembly for drawer and more specifically, to a sliding rail assembly auto locking structure, which assures positive locking of the sliding rail assembly and smooth motion of the sliding rail assembly.

FIGS. 1 and 2 illustrate a sliding rail assembly auto locking structure used in a sliding rail assembly 9 for drawer. This sliding rail assembly auto locking structure comprises a holder base 91, a spring member 92, a slide 93, and a push block 941 at the inner sliding rail 94. Because the spring member 92 is mounted in a spring chamber 912 inside the holder base 91, the spring member 92 is forced to rub against the inside wall of the spring chamber 912 when it is alternatively compressed and stretched. Therefore, the spring member 92 wears quickly with use. Further, it is difficult to replace the spring member 92 when the spring member 92 is damaged. Further, the slide 93 has two guide rods 931 and 932 for guiding reciprocating motion of the slide 93 in a sliding groove 911 inside the holder base 91. The sliding groove 911 has a downwardly extending front retaining groove portion 9111 for receiving one guide rod 931. When the user arranges the drawer or touches the drawer accidentally, the guide rod 931 of the slide 93 may be forced out of the front retaining groove portion 9111 of the sliding groove 911, causing the slide 93 to be pulled backwards by the spring member 92. In this case, the auto locking structure fails to function normally, and the drawer cannot be pushed to the rear side. U.S. Pat. Nos. 5,207,781 and 5,302,016 and PCT WO 01/8279A2 have same drawbacks. Further, the spring member 93 has one end hooked on one guide rod 931 of the slide 93 and is kept in a oblique manner, i.e., the spring member 93 is not horizontally stretched and compressed, resulting in instability of the reciprocating motion of the slide 93 and short working life of the spring member 93. Further, because the slide 93 vibrates heavily when it is pulled directly by the spring member 92 during its return stroke.

Therefore, it is desirable to provide a sliding rail assembly auto locking structure that eliminates the aforesaid drawbacks.

The present invention has been accomplished under the circumstances in view. According to one aspect of the present invention, the sliding rail assembly auto locking structure is comprised of a holder base, a swivel hook, a slide, two return springs, and a hydraulic cylinder. When an arched block of the swivel hook is approaching a recess in the holder base for positioning, the arched block does not fall to the recess directly. At this time, oblique guide grooves of the swivel hook are moved over associating guide blocks of the holder base to guide the arched block into the recess slowly and smoothly, and therefore the inner sliding rail of the sliding rail assembly is moved with the drawer smoothly without vibration.

According to another aspect of the present invention, the oblique guide grooves of the swivel hook are positively supported on the guide blocks of the holder base when the arched block entered the recess of the holder base, thereby holding the swivel hook in a tilted position where the swivel hook is disengaged from the actuating block at the inner sliding rail for allowing the drawer to be pulled to the outside of the desk. Because the oblique guide grooves of the swivel hook are positively supported on the guide blocks of the holder base, vibration of the drawer caused accidentally by an external force or an earthquake does not cause the swivel hook to be moved away from the guide blocks and pulled backwards by the return springs and the slide.

According to still another aspect of the present invention, the return springs are suspending at two sides outside the holder base. When the return springs are stretched or compressed, the return springs do not rub against the outside wall of the holder bas. Therefore, the return springs are durable in use, and replacement of the return springs can easily be performed.

According to still another aspect of the present invention, the swivel hook is coupled to the slide and has the two guide rods respectively slidably coupled to the longitudinal sliding slots of the holder base, and the slide is connected to the return springs and has the two guide blocks thereof respectively slidably coupled to the longitudinal sliding slots of the holder base. This arrangement assures smooth reciprocation of the swivel hook and the slide in the holder base. Further, the hydraulic cylinder buffers the return stroke of the slide, eliminating vibration and noise.

DETAILED DESCRIPTION OF THE INVENTION

Figure 1:
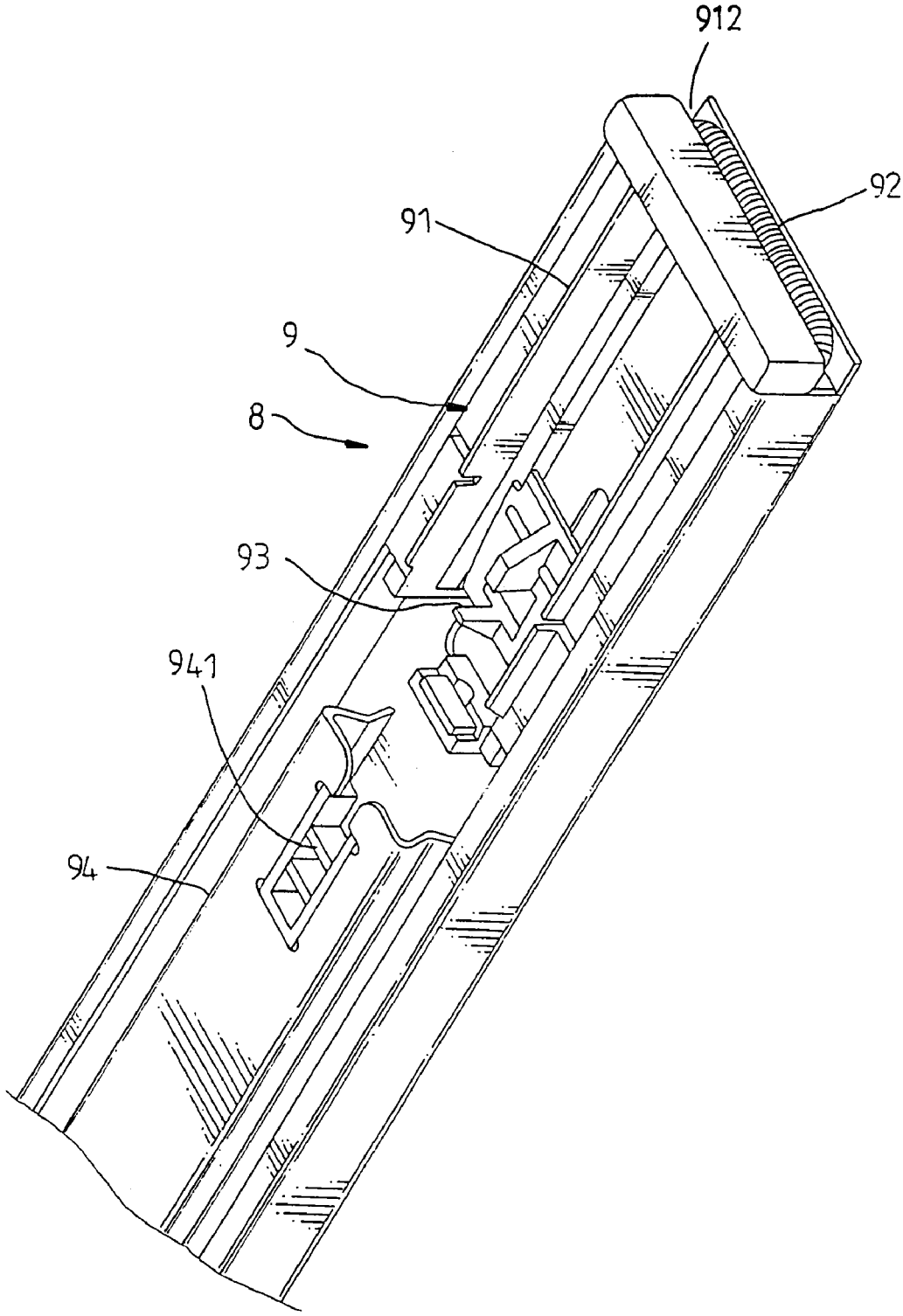
Fig. 1 PRIOR ART
FIG. 1 is a perspective view of a part of a sliding rail assembly auto locking structure according to the prior art.
Figure 2:
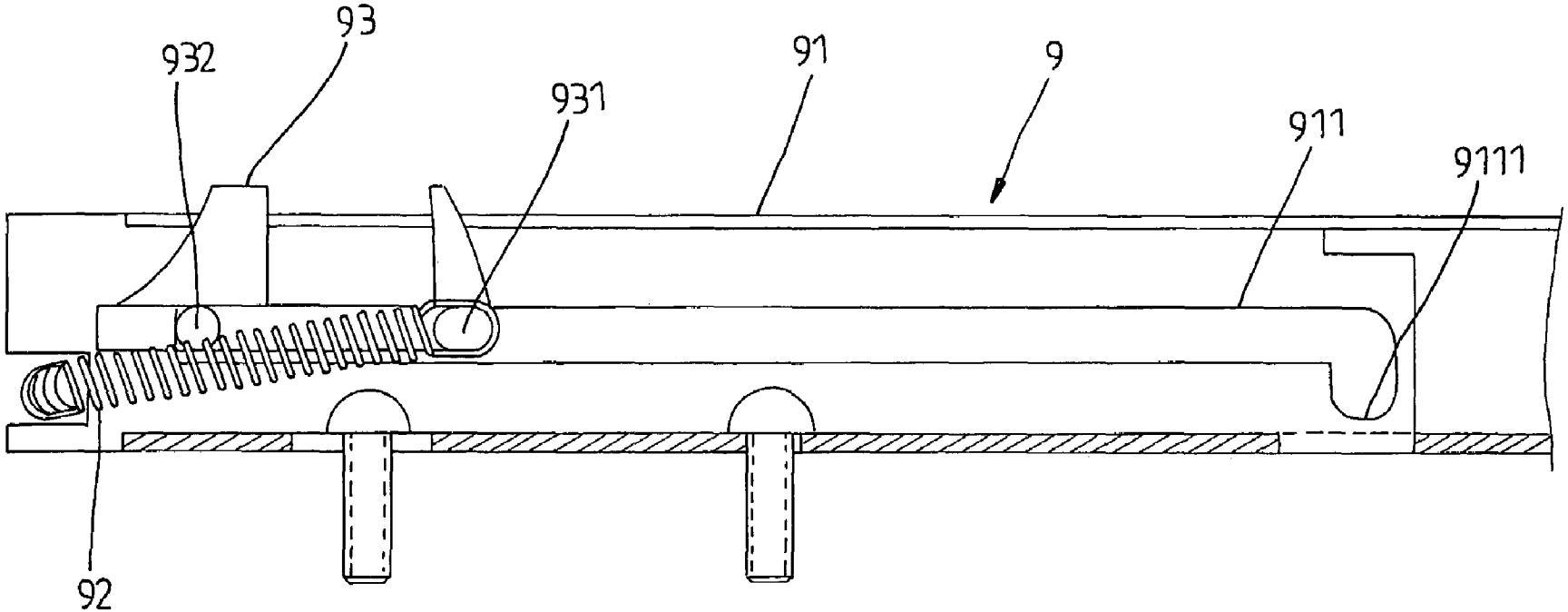
Fig. 2 PRIOR ART
FIG. 2 is a schematic side view of the sliding rail assembly auto locking structure according to the prior art.
Figure 3:
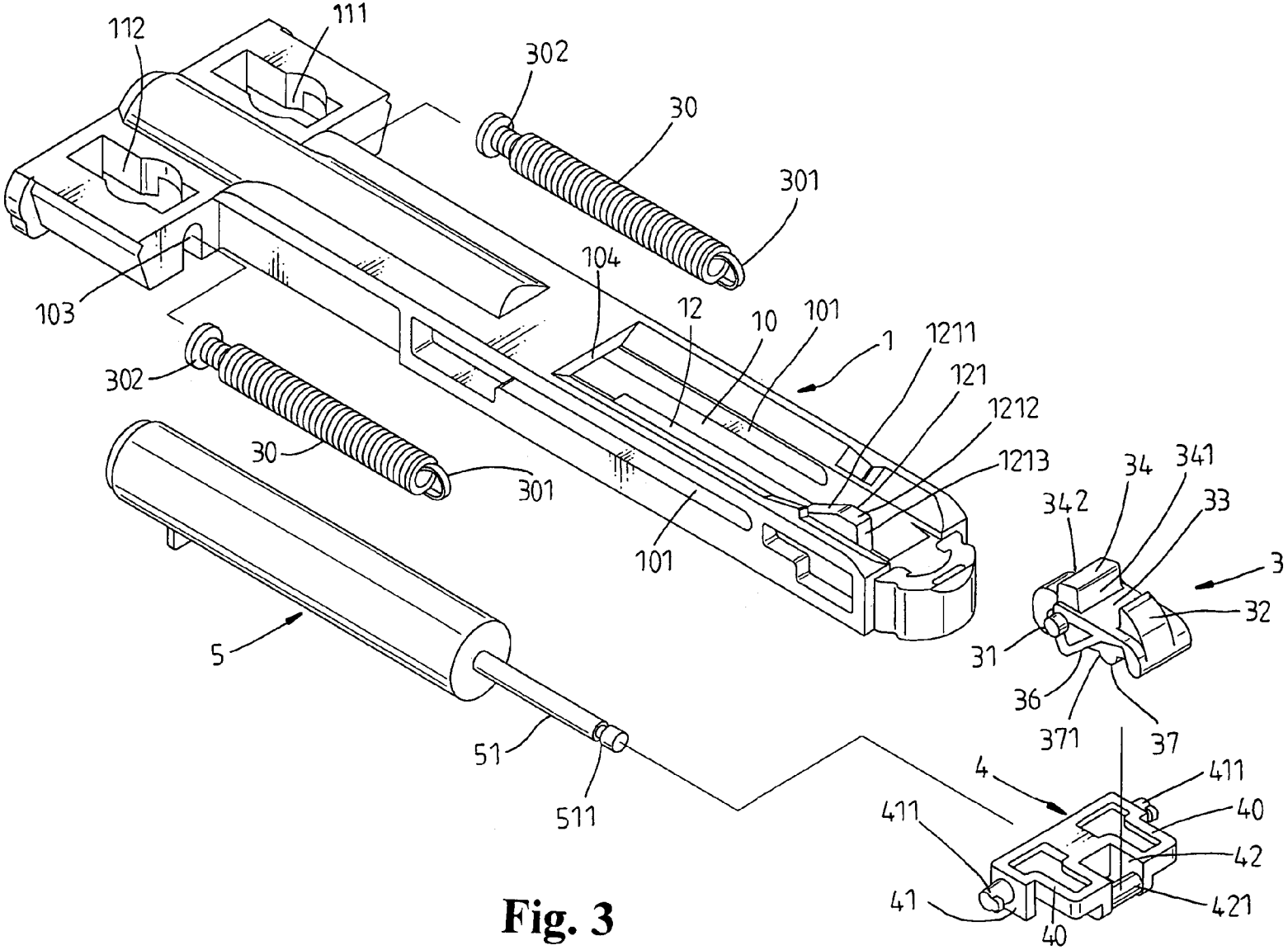
FIG. 3 is an exploded view of a sliding rail assembly auto locking structure according to the present invention.
Figure 4:
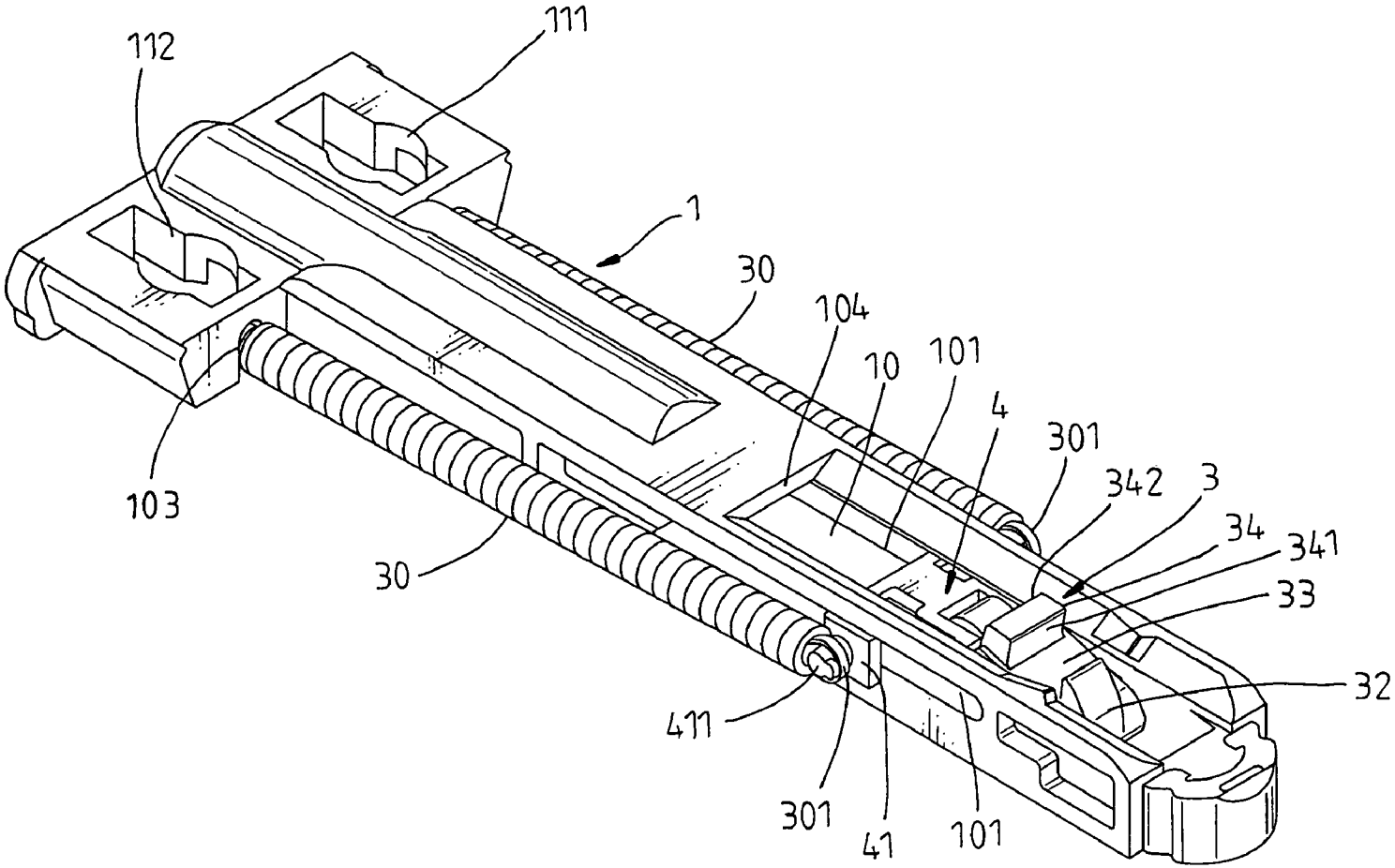
FIG. 4 is an oblique top elevation of the sliding rail assembly auto locking structure according to the present invention.

Referring to F FIGS. 3~14, a sliding rail assembly auto locking structure is shown used in a sliding rail assembly 2 for drawer. The sliding rail assembly 2 comprises an outer sliding rail 21 affixed to a drawer and an inner sliding rail 22 affixed to a desk and longitudinally movable in and out of the outer sliding rail 21. The sliding rail assembly auto locking structure comprises a holder base 1, a swivel hook 3, a slide 4, an actuating block 221, and two return springs 30.

The holder base 1 has two mounting through holes 111 and 112 fixedly fastened to the outer sliding rail 21 of the sliding track assembly 2, two rear locating notches 103 bilaterally disposed at the rear side, a bottom wall 12 defining a longitudinal sliding groove 10, two longitudinal sliding slots 101 extending along two opposite lateral sides of the longitudinal sliding groove 10, two guide blocks 121 bilaterally and upwardly protruded from the bottom wall 12 at the front side (see FIG. 9), a gap 13 defined between the two guide blocks 12 (see FIG. 6), a recess 131 formed in the bottom side of the gap 13 (see FIG. 10), a locating portion 104 at the rear end of the sliding groove 10. The guide blocks 121 are trapezoidal blocks, each having a backwardly downwardly extending rear sloping guide edge 1211, a vertical front stop edge 1213, and a horizontal top edge 1212 connected between the rear sloping guide edge 1211 and the vertical front stop edge 1213.

The swivel hook 3 comprises two guide rods 31 disposed at two opposite lateral sides and respectively coupled to the longitudinal sliding slots 101 of the holder base 1 to guide movement of the swivel hook 3 along the longitudinal sliding groove 10, a forwardly downwardly extending front sloping guide edge 32, a rear stop block 34, a locating recess 33 defined between the front sloping guide edge 32 and the rear stop block 34, a rear coupling groove 35 transversely disposed in the bottom wall at the rear side (see FIG. 10), two oblique guide grooves 36 bilaterally disposed at the bottom side on the middle corresponding to the guide blocks 121 of the holder base 1, and an arched block 37 at the front bottom side. The rear stop block 34 has a vertical front wall 341 facing the locating recess 33, and a vertical back wall 342 stoppable by the locating portion 104 of the holder base 1.

The slide 4 is axially slidably mounted in the longitudinal sliding groove 10 of the holder base 1, comprising two guide blocks 41 respectively protruded from the two opposite lateral sidewalls 40 thereof and respectively coupled to the longitudinal sliding slots 101 of the holder base 1 to guide reciprocating motion of the slide 4 in the longitudinal sliding groove 10 of the holder base 1, two hooked portions 411 respectively extending from the guide blocks 41, a front opening 42, and a coupling rod 421 transversely suspending in the front opening 42 and coupled to the coupling groove 35 of the swivel hook 3.

The two return springs 30 each have a rear end 302 respectively fastened to the rear locating notches 103 of the holder base 1 and a front end 301 respectively fastened to the hooked portions 411 of the stop blocks 42 of the slide 4.

Figure 5:
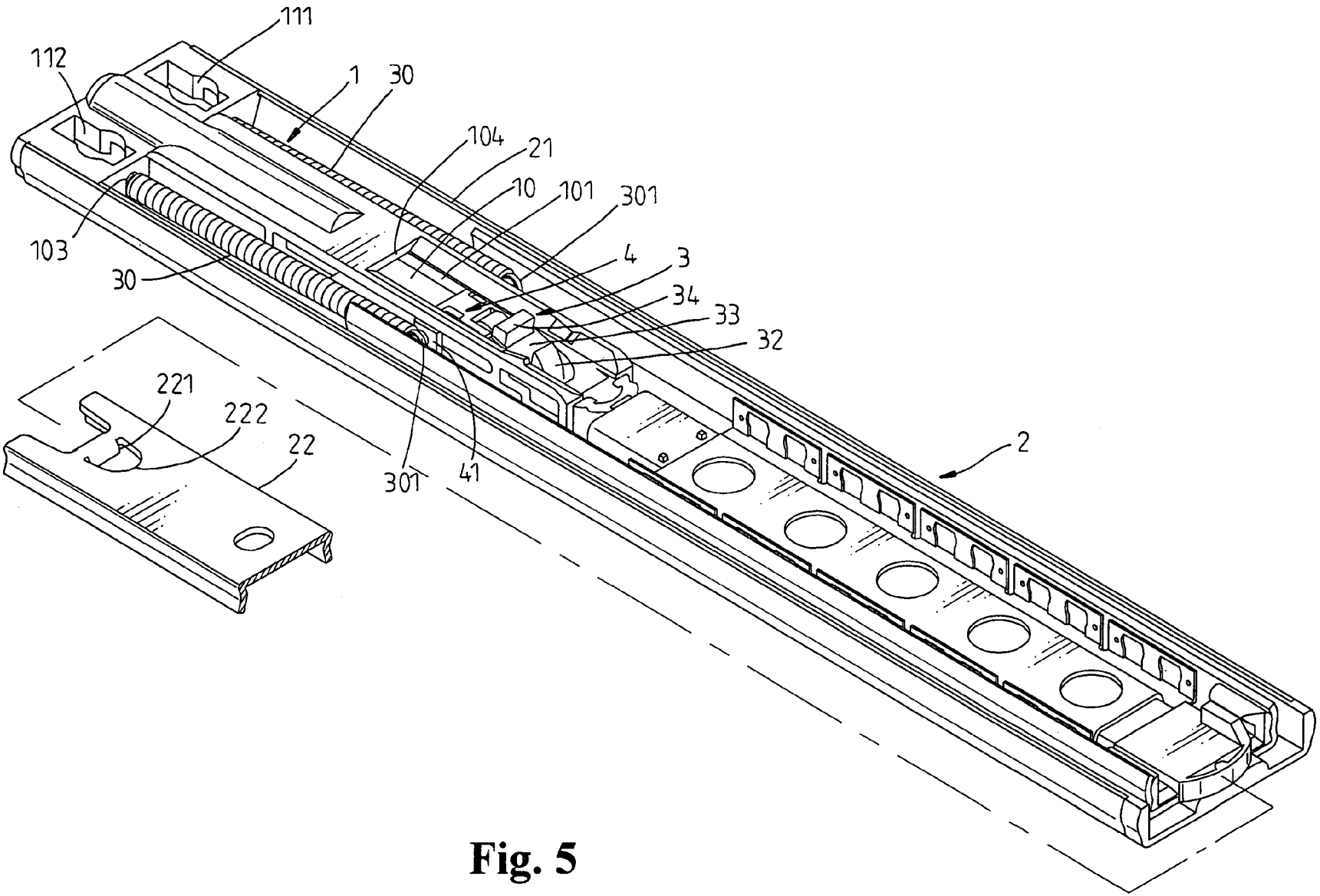
FIG. 5 is an exploded view showing the sliding rail assembly auto locking structure mounted in the outer sliding rail before installation of the inner sliding rail.
Figure 6:
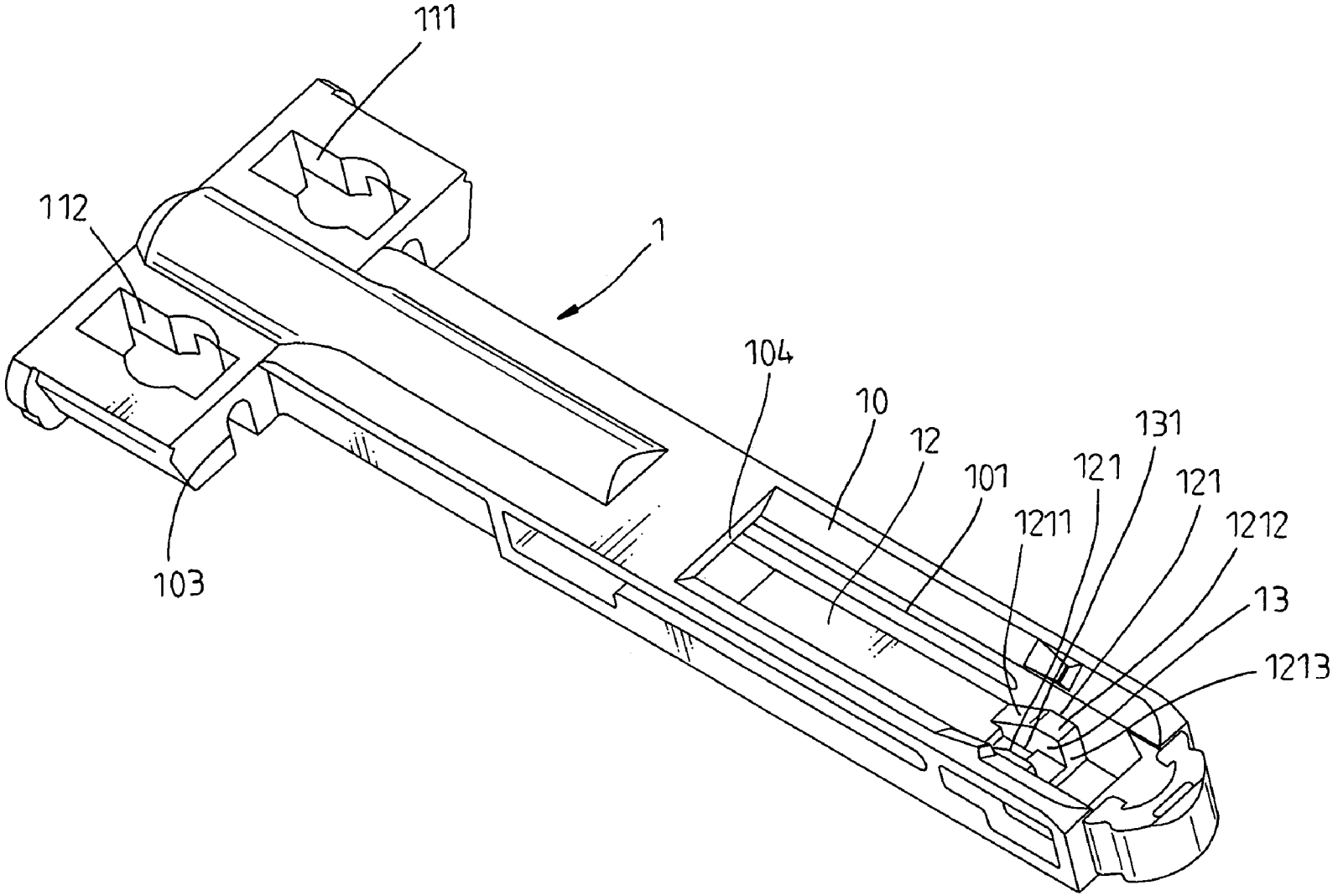
FIG. 6 is an oblique bottom elevation of the sliding rail assembly auto locking structure according to the present invention.
Figure 7:
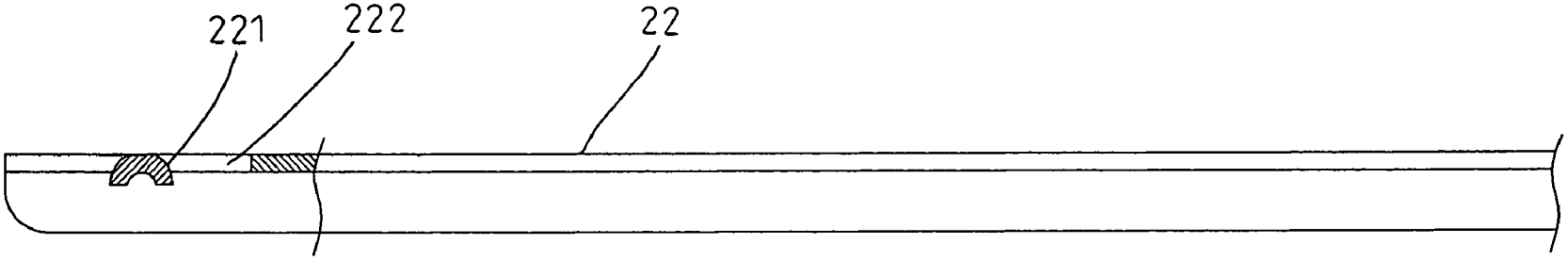
FIG. 7 is a sectional side view of a part of the inner sliding rail of the sliding rail assembly according to the present invention.
Figure 8:
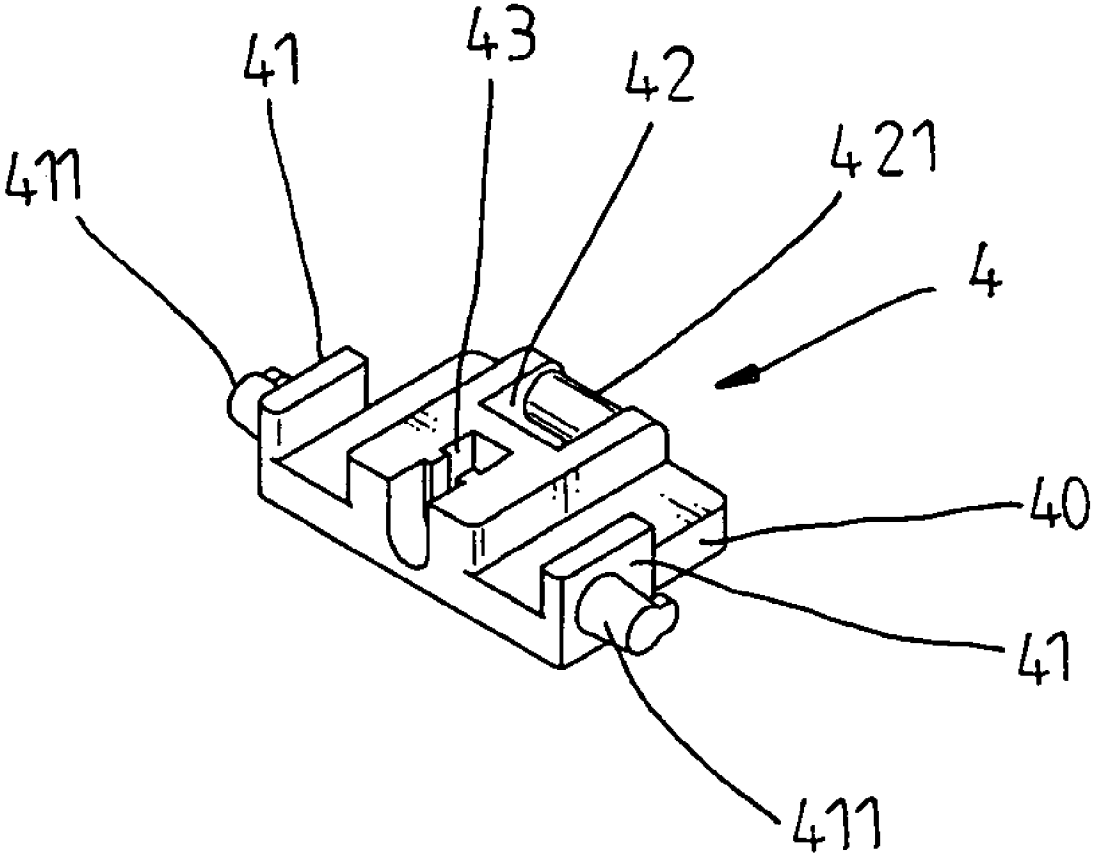
FIG. 8 is an oblique elevation of the slide according to the present invention.
Figure 9:
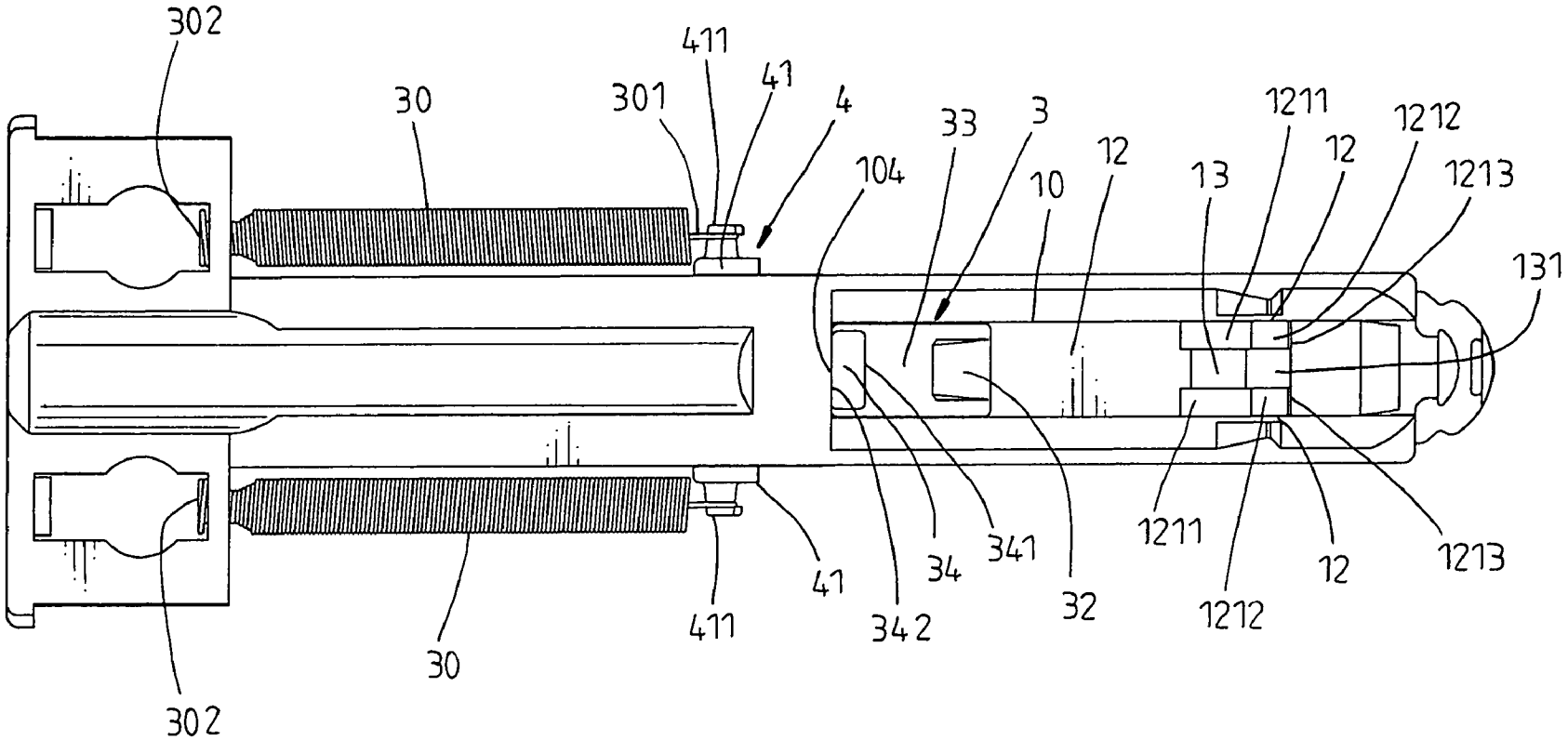
FIG. 9 is a schematic top view of the present invention, showing the swivel hook stopped at the locating portion of the holder base.
Figure 10:
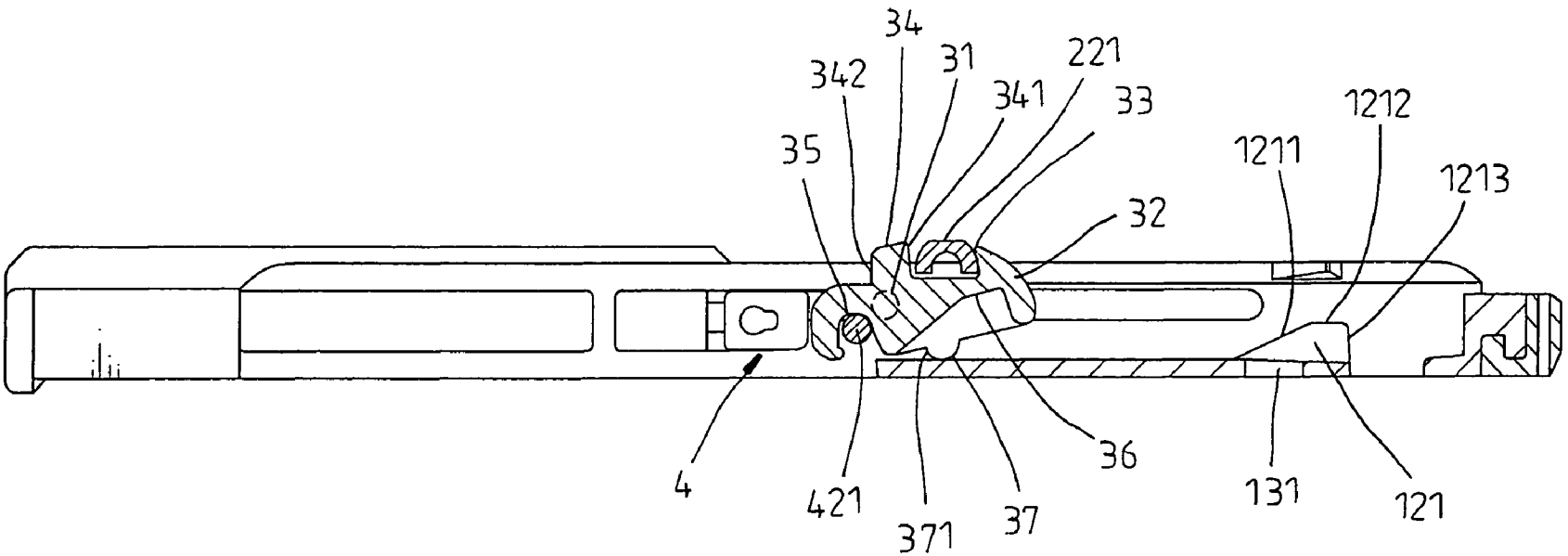
FIG. 10 is a schematic side view of FIG. 9.

The actuating block 221 is fixedly provided at the inner sliding rail 22 of the sliding track assembly 2 (see FIGS. 5 and 7). According to this embodiment, the actuating block 221 is a curved block formed integral with a part of the inner sliding rail 22 in an opening 222 of the inner sliding rail 22.

Figure 11:
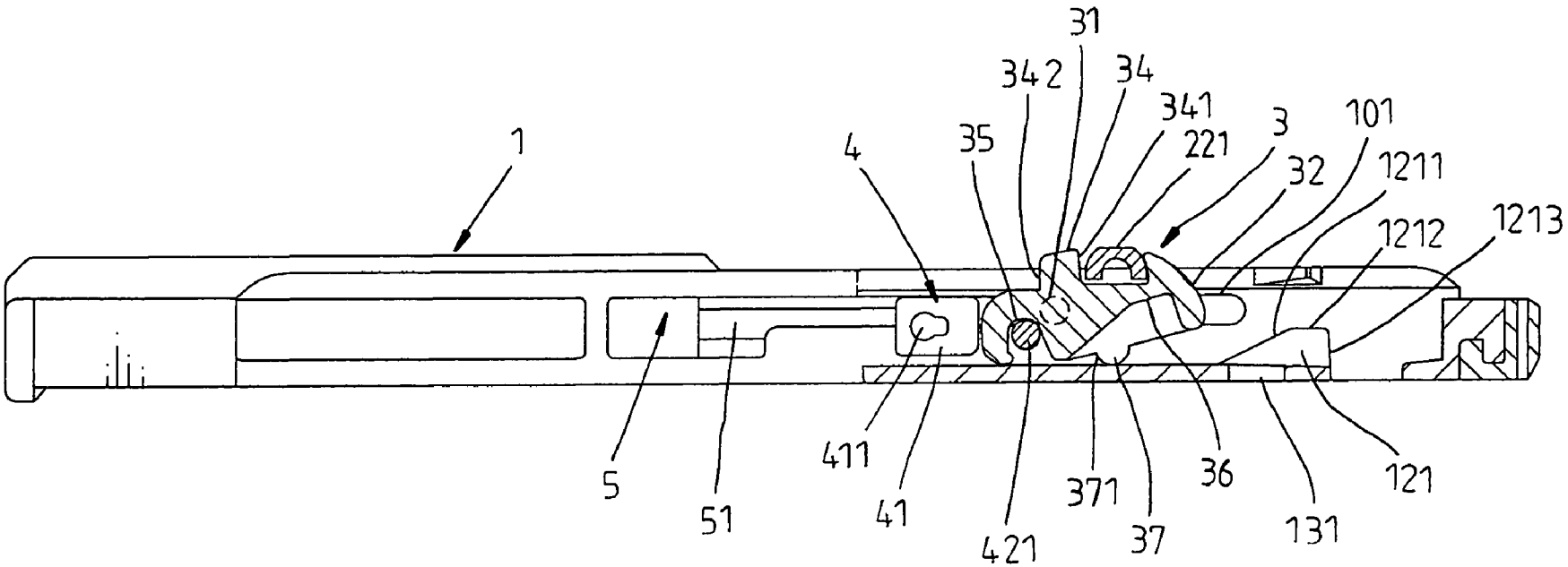
FIG. 11 is a schematic side view of the present invention, showing the swivel hook moved toward the guide blocks of the holder base.
Figure 12:
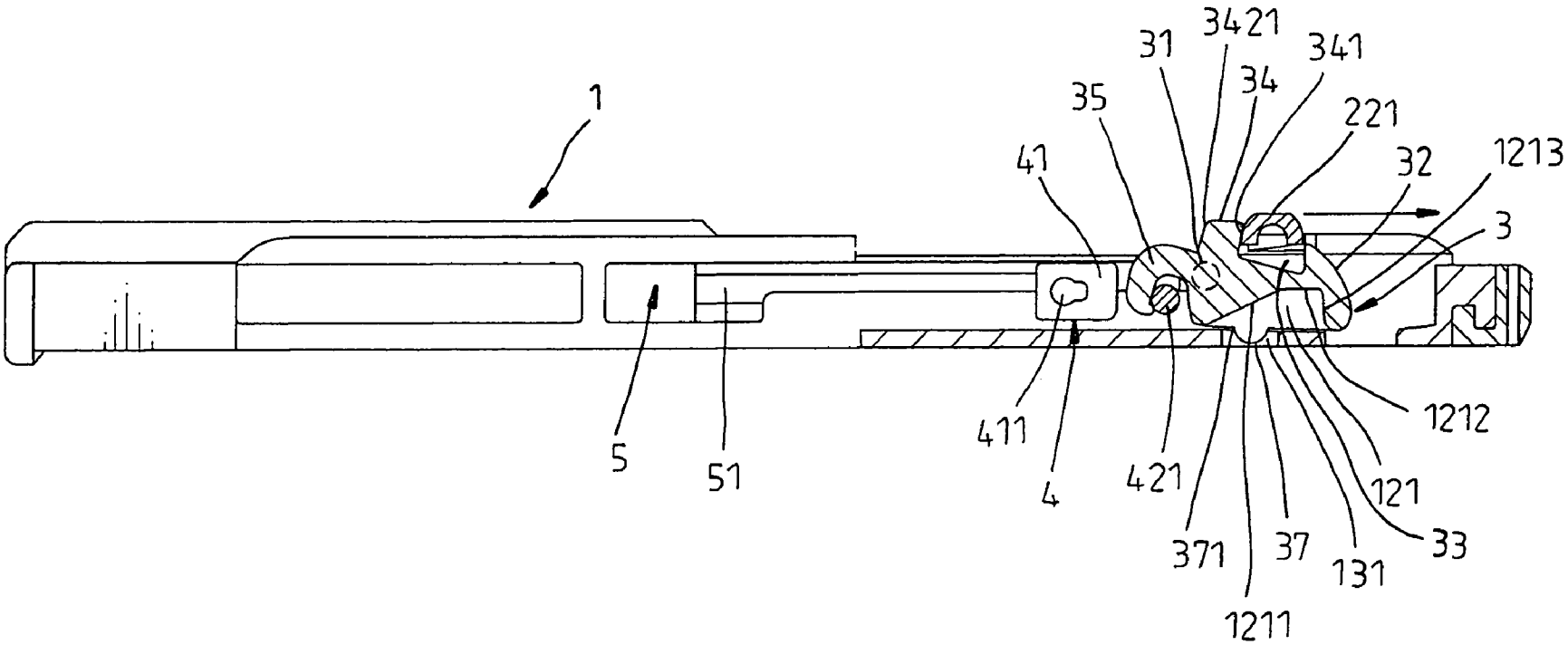
FIG. 12 is similar to FIG. 11 but showing the oblique guide grooves attached to the associating guide blocks of the holder base.

When the user pulls the drawer (not shown) out of the desk, the inner sliding rail 22 is moved forwards with the drawer, and the actuating block 221 carries the swivel hook 3 forwards along the longitudinal sliding groove 10 of the holder base 1 (see FIG. 11). At the same time, the slide 4 is carried forwards by the swivel hook 3 to stretch the return springs 30. When the arched block 37 of the swivel hook 3 is approaching the gap 13, the oblique guide grooves 36 are moved over the guide blocks 121 of the holder base 1, and the arched rear side 371 of the arched block 37 is moved smoothly into the recess 131 (see FIGS. 12 and 13) to tilt the swivel hook 3 and to further disengage the locating recess 33 from the actuating block 221, allowing the drawer to be continuously pulled forward (in the direction indicated by the arrowhead sign in FIG. 12) to the open position. On the contrary, when the user pushes the drawer backwards toward the inside of the desk, the actuating block 211 is stopped at the vertical front wall 341 of the rear stop block 34 of the swivel hook 3 to bias the swivel hook 3 and to further move the oblique guide grooves 36 of the swivel hook 3 away from the guide blocks 121 of the holder base 1 and the arched block 37 away from the recess 131, allowing the return springs 30 to pull the slide 4 and the swivel hook 3 with the inner sliding rail 22 and the drawer backwards to the received (close) position where the vertical back wall 342 of the rear stop block 34 of the swivel hook 3 is stopped at the locating portion 104 of the holder base 1 (see FIGS. 9 and 10).

Figure 13:
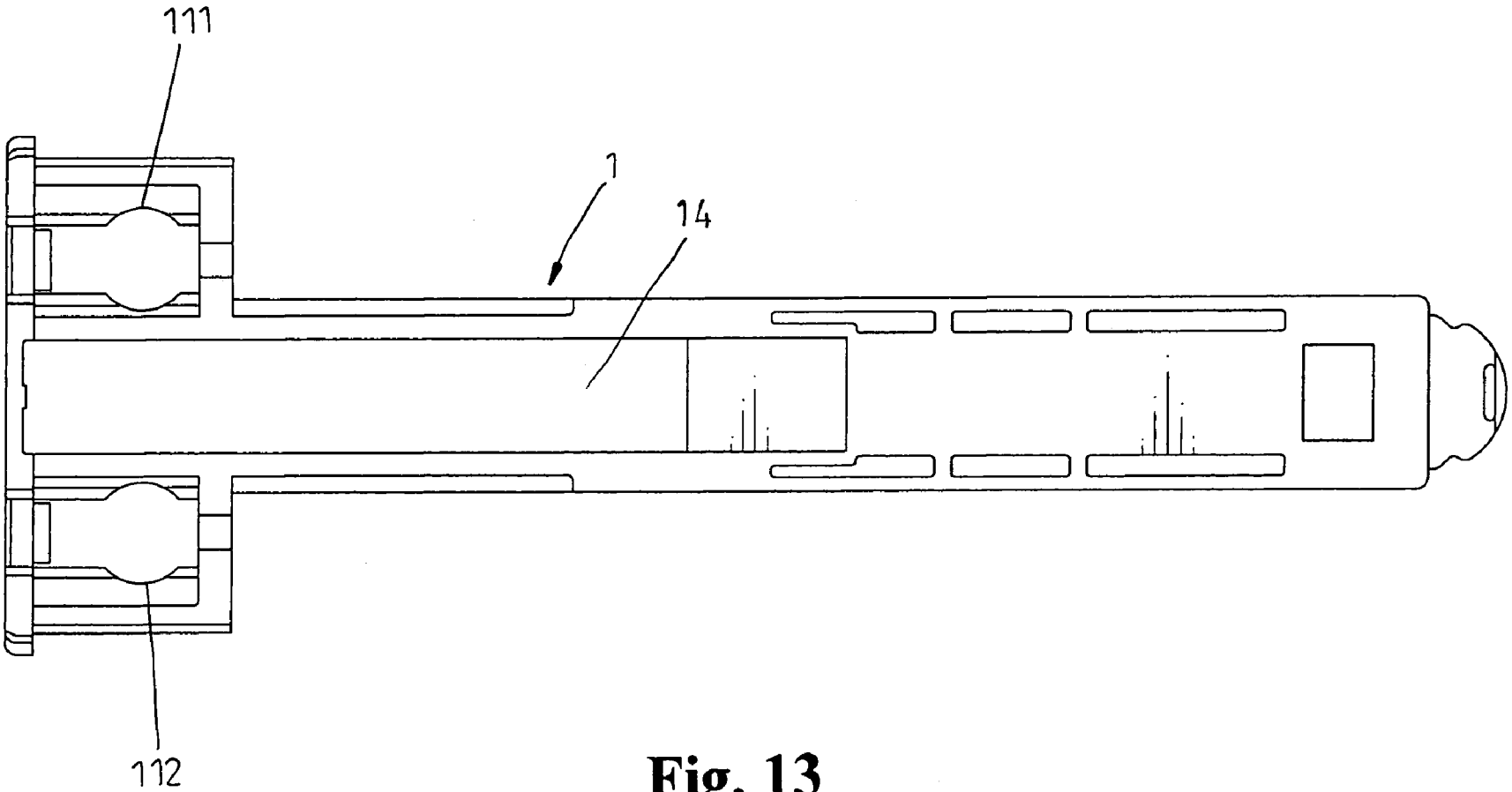
FIG. 13 is a bottom plain view of the holder base according to the present invention.

The holder base 1 further has an accommodation groove 14 that accommodates a hydraulic cylinder 5 (see FIG. 13). The outer front end 511 of the reciprocating rod 51 of the hydraulic cylinder 5 is fastened to a locating groove 43 of the slide 4 (see FIG. 8). When the return springs 30 are pulling the slide 4 backwards, the reciprocating rod 51 is moved backwards to the inside of the hydraulic cylinder 5 to buffer the return stroke of the slide 4, thereby eliminating vibration and noise and prolonging the working life of the related parts.

In the aforesaid embodiment, the guide blocks 121 of the holder base 1 are stepped blocks, and the oblique guide grooves 36 of the swivel hook 3 are stepped grooves fitting the stepped guide blocks 121. Alternatively, the guide blocks 121 can be made in any of a variety of other polygonal shapes.

Further, the locating notches 103 of the holder base 1 are bilaterally formed in the bottom wall of the expanded rear side of the holder base. The return springs 30 are respectively connected between the locating notches 103 of the holder base 1 and the hooked portions 411 of the slide 4 and bilaterally suspending outside the holder base 1. When the return springs 30 are stretched or compressed, the return springs 30 do not rub against the outside wall of the holder base 1. Therefore, the return springs 30 are durable in use, and replacement of the return springs 8 can easily be performed.

Figure 14:
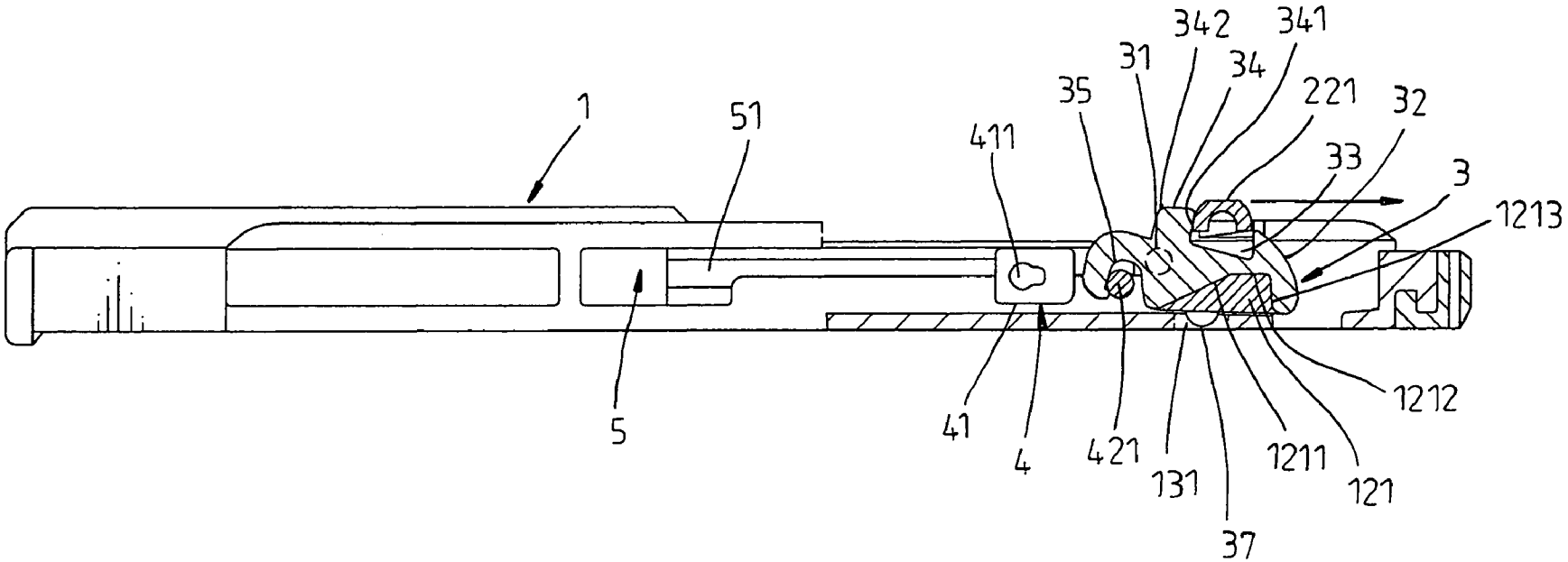
FIG. 14 is a schematic side view of an alternate form of the sliding rail assembly auto locking structure according to the present invention.
Figure 15:
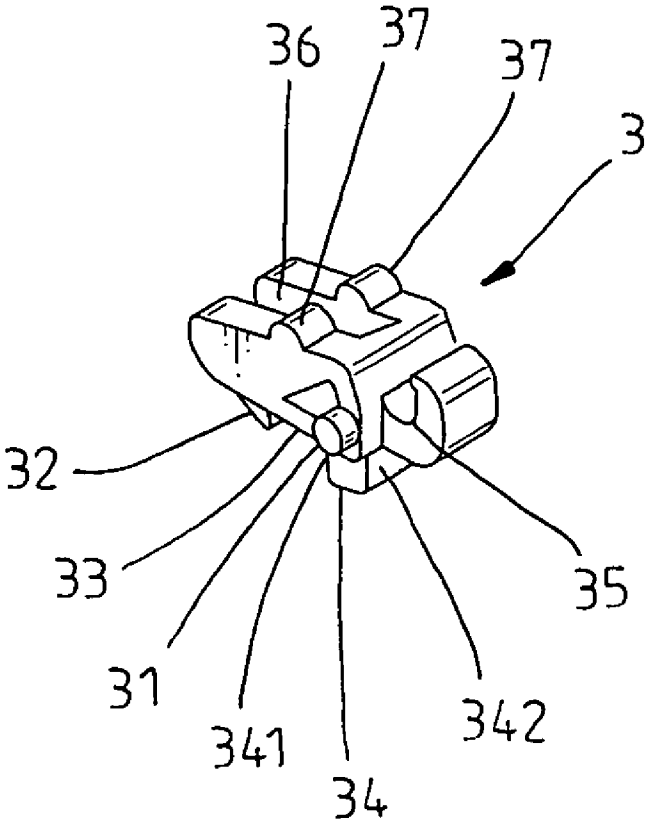
FIG. 15 is an oblique elevation of the swivel hook of the alternate form of the sliding rail assembly auto locking structure according to the present invention.
Figure 16:
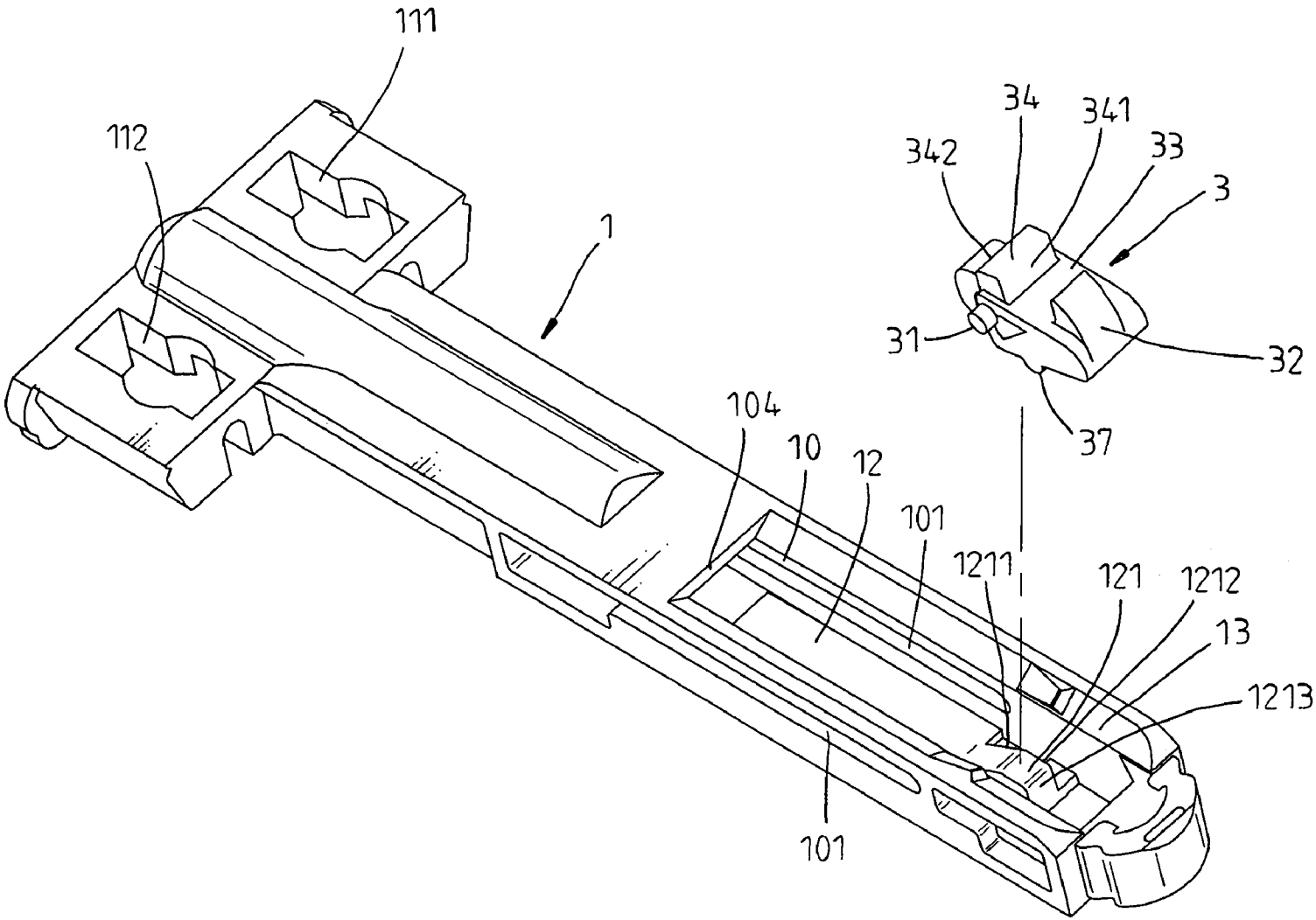
FIG. 16 is an exploded view of the alternate form of the sliding rail assembly auto locking structure according to the present invention.

FIGS. 14~16 show an alternate form of the present invention. According to this embodiment, the holder base 1 has only one guide block 121 at the front side. The guide block 121 protrudes upwardly from the bottom wall 12 on the middle near the front side. The guide block 121 is a trapezoidal block, having a downwardly backwardly extending rear sloping guide edge 1211, a vertical front stop edge 1213, and a horizontal top edge 1212 connected between the rear sloping guide edge 1211 and the vertical front stop edge 1213. The holder base 1 further defines two gaps 13 at two sides of the guide block 121, and a recess 131 in each gap 13. Further, the swivel hook 3 has an oblique guide groove 36 formed in the front bottom side on the middle. The oblique guide groove 36 fits the guide block 121 in shape and size. After installation of the swivel hook 3 in the holder base 1, the oblique guide groove 36 defines with the bottom wall 12 of the holder base 1 a contained angle. The swivel hook 3 further has two arched blocks 37 bilaterally protruded from the bottom wall near the rear side of the oblique guide groove 36.

When the user pulls the drawer (not shown) out of the desk, the inner sliding rail 22 is moved forwards with the drawer, and the actuating block 221 carries the swivel hook 3 forwards along the longitudinal sliding groove 10 of the holder base 1 At the same time, the slide 4 is carried forwards by the swivel hook 3 to stretch the return springs 30. When the arched blocks 37 of the swivel hook 3 are approaching the gaps 13, the oblique guide groove 36 is moved over the guide block 121 of the holder base 1, and the arched rear side 371 of each arched block 37 is moved smoothly into the associating recess 131 to tilt the swivel hook 3 and to further disengage the locating recess 33 from the actuating block 221, allowing the drawer to be continuously pulled forward to the open position.

As indicated above, the sliding rail assembly auto locking structure has the following benefits:

1. When the arched block 37 is approaching the recess 131, the arched block 37 does not directly fall to the recess 131. At this time, the oblique guide grooves 36 of the swivel hook 3 are moved over the associating guide blocks 121 of the holder base 1 to guide the arched rear side 371 of the arched block 37 into the recess 131 slowly and smoothly, and therefore the inner sliding rail 22 is moved with the drawer smoothly without vibration.

2. When the arched block 37 entered the recess 131 in the bottom wall 12 of the holder base 1, the oblique guide grooves 36 are positively supported on the guide blocks 121 of the holder base 1, holding the swivel hook 3 in a tilted position where the locating recess 33 of the swivel hook 3 is disengaged from the actuating block 221 at the inner sliding rail 2 for allowing the drawer to be pulled to the outside of the desk. Because the oblique guide grooves 36 of the swivel hook 3 are positively supported on the guide blocks 121 of the holder base 1, vibration of the drawer caused accidentally by an external force or an earthquake does not cause the swivel hook 3 to be moved away from the guide blocks 121 and pulled backwards by the return springs 30 and the slide 4.

3. The return springs 30 are suspending at two sides outside the holder base 1. When the return springs 30 are stretched or compressed, the return springs 30 do not rub against the outside wall of the holder base 1. Therefore, the return springs 30 are durable in use, and replacement of the return springs 30 can easily be performed.

4. The swivel hook 3 is coupled to the slide 4 and has the two guide rods 31 respectively slidably coupled to the longitudinal sliding slots 101 of the holder base 1, and the slide 4 is connected to the return springs 30 and has the two guide blocks 41 respectively slidably coupled to the longitudinal sliding slots 101 of the holder base 1. This arrangement assures smooth reciprocation of the swivel hook 3 and the slide 4 in the holder base 1. Further, the hydraulic cylinder 10 buffers the return stroke of the slide 4, eliminating vibration and noise.

What is claimed is:

1. A sliding rail assembly auto locking structure used in a sliding rail assembly, said sliding rail assembly comprising an outer sliding rail affixed to a drawer and an inner sliding rail affixed to a desk and longitudinally movable in and out of said outer sliding rail, the sliding rail assembly auto locking structure comprising:

a holder base fixedly fastened to said outer sliding rail, said holder base comprising two rear locating notches bilaterally disposed at a rear side thereof, a bottom wall defining a longitudinal sliding groove, two longitudinal sliding slots extending along two opposite lateral sides of said longitudinal sliding groove, two guide blocks bilaterally and upwardly protruded from a front side of said bottom wall, a gap defined between said two guide blocks, and a recess formed in a bottom side of said gap, said guide blocks each having a backwardly downwardly extending rear sloping guide edge, a vertical front stop edge, and a horizontal top edge connected between said rear sloping guide edge and said vertical front stop edge;

a swivel hook, said swivel hook comprising two guide rods disposed at two opposite lateral sides thereof and respectively coupled to said longitudinal sliding slots of said holder base to guide movement of said swivel hook along said longitudinal sliding groove of said holder base, a forwardly downwardly extending front sloping guide edge, a rear stop block, a locating recess defined between said front sloping guide edge and said rear stop block, a rear coupling groove transversely disposed in a rear side of a bottom wall thereof, two oblique guide grooves bilaterally disposed at the bottom side on the middle corresponding to the guide blocks of said holder base, and an arched block disposed at the bottom side in front of said oblique guide grooves;

a slide axially slidably mounted in the longitudinal sliding groove of said holder base, said slide comprising two guide blocks respectively protruded from two opposite lateral sidewalls thereof and respectively coupled to said longitudinal sliding slots of said holder base to guide reciprocating motion of said slide in said longitudinal sliding groove of said holder base, two hooked portions respectively extending from the guide blocks of said slide, a front opening, and a coupling rod transversely suspending in said front opening and coupled to the coupling groove of said swivel hook;

two return springs respectively connected between the rear locating notches of said holder base and the hooked portions of said slide; and an actuating block fixedly provided at said inner sliding rail of said sliding track assembly;

wherein when said drawer is pulled out of said desk, said inner sliding rail is moved forwards with said drawer, and said actuating block carries said swivel hook forwards along said longitudinal sliding groove of said holder base, and at the same time, said slide is carried forwards by said swivel hook to stretch said return springs; when said arched block of said swivel hook is approaching said gap, said oblique guide grooves of said swivel hook are moved over the guide blocks of said holder base to force said arched block into said recess of said holder base smoothly and to simultaneously tilt said swivel hook so that said swivel hook is disengaged from said actuating block for allowing said drawer to be continuously pulled forward to the outside of said desk; on the contrary, when said drawer is pushed backwards toward the inside of said desk, said actuating block is stopped at said rear stop block of said swivel hook to bias said swivel hook and to further move the oblique guide grooves of said swivel hook away from the guide blocks of said holder base and the arched block of said swivel hook away from the recess of said holder base, for allowing said return springs to pull said slide and said swivel hook with said inner sliding rail and said drawer backwards to the inside said desk.

2. The sliding rail assembly auto locking structure as claimed in claim 1, wherein said bolder base further comprises an accommodation groove, and a hydraulic cylinder fixedly mounted in said accommodation groove, said hydraulic cylinder having reciprocating rod connected to said slide for buffering return stroke of said slide.

3. The sliding rail assembly auto locking structure as claimed in claim 1, wherein said actuating block is formed integral with a part of said inner sliding rail of said sliding rail assembly by stamping.

4. The sliding rail assembly auto locking structure as claimed in claim 3, wherein said actuating block is smoothly arched.

5. The sliding rail assembly auto locking structure as claimed in claim 1, wherein the guide blocks of said holder base have a polygonal shape.

6. The sliding rail assembly auto locking structure as claimed in claim 1, wherein said holder base has the rear side thereof bilaterally outwardly protruded, and two mounting through holes formed in the rear side for fastening to said outer sliding rail of said sliding rail assembly; the rear locating notches are formed in the protruded rear side of said holder base to hold one end of each of said return springs, keeping said return springs suspended outside said holder base.

* * * * *